United States Patent [19]

Reüss

[11] Patent Number: 4,568,136

[45] Date of Patent: Feb. 4, 1986

[54] SOCKET TERMINAL STRIP

[75] Inventor: Oswald Reüss, Unterelsbach, Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 633,113

[22] Filed: Jul. 20, 1984

[30] Foreign Application Priority Data

Jul. 29, 1983 [DE] Fed. Rep. of Germany ..... 3327414

[51] Int. Cl.[4] ..... H01R 13/50

[52] U.S. Cl. ..... 339/176 M; 339/17 M

[58] Field of Search ..... 339/17 LE, 17 LM, 17 M, 339/154 R, 154 A, 154 L, 155 R, 155 L, 155 T, 156 R, 156 T, 176 M

[56] References Cited

U.S. PATENT DOCUMENTS

| | | | |
|---|---|---|---|
| 3,136,591 | 6/1964 | Just et al. | 339/17 LM |
| 3,639,893 | 2/1972 | Kunkle et al. | 339/220 R |
| 3,660,803 | 5/1972 | Cooney | 339/17 LM |
| 4,225,209 | 9/1980 | Hughes | 339/17 LC |
| 4,264,114 | 4/1981 | Chandler | 339/17 LC |
| 4,286,837 | 9/1981 | Yasutake et al. | 339/176 MP |
| 4,410,230 | 10/1983 | San Miguel | 339/176 M |

FOREIGN PATENT DOCUMENTS

| | | |
|---|---|---|
| 2104406 | 12/1971 | Fed. Rep. of Germany . |
| 2452402 | 5/1976 | Fed. Rep. of Germany . |
| 2851712 | 6/1980 | Fed. Rep. of Germany . |

*Primary Examiner*—Gil Weidenfeld
*Assistant Examiner*—Gary F. Paumen
*Attorney, Agent, or Firm*—Woodcock Washburn Kurtz Mackiewicz & Norris

[57] ABSTRACT

A socket terminal strip is provided for receiving a complementary plug strip provided with knife contact pins. The socket terminal strip has an insulating body in whose chambers contact members are arranged. A row of webs extending crosswise is positioned longitudinally on the back side, which webs are separated from each other by incisions, so that a chamber-like arrangement is formed. In order to provide for increased connection possibilities with different contact assignment for the same number of contacts, a row of webs and incisions is provided on each of the two longitudinal edges on the back side of the insulating body, which webs and incisions are staggered. An incision of the second row is thus opposite to a corresponding web of the first row, and a web of the second row is opposite to a corresponding incision of the first row. Each chamber has two contact members with connection parts which reach out of the insulating body on opposing sides, such that the connection part are led alternatively over the webs and lie in the incisions. By this means electrically common connection lugs can then be soldered into different printed-circuit boards, thereby increasing the number of different connections that can be made to the plug strip.

10 Claims, 5 Drawing Figures

SOCKET TERMINAL STRIP

BACKGROUND OF THE INVENTION

1. Field of the Invention

The present invention relates to a type of socket terminal strip known as a peritelevision connection.

2. Description of the Prior Art

Due to the new services introduced in radio and television communications, especially in the private sector, peritelevision is of increasing significance. There are a large number of new applications in the area of video technology, e.g., video recorders, electronic games, video cameras, videography, text display on the television screen, and many others. The field also includes the introduction of home computers. The private television set serves as a display unit in these applications. These new services, or the corresponding audiovisual devices, should be easy to operate for the average person. It was therefore necessary to create a universal connection for the different devices of the audiovisual system. This connection consists of a socket part which is rigidly mounted on the device, and of a plug part which is at the end of a flexible cable. Both parts have two rows of 10 contacts each in a staggered pattern, and an additional contact for screening; the screening surrounds the insulating part which carrier the individual contacts. Fork springs are used as contacts, the assignment of the individual contacts being specified in accordance with a standard. Depending on the intended application, there are four types of cable, of which one type contains all the connections specified in the standard. Another type contains all video connections except radio. The third type contains the connections for audio and video signals, but without RGB for color television. The last type includes all audio connections except video.

A fork spring which is inserted into a chamber of a socket terminal strip is already known from DE-OS [West German Offenlegungsschrift] No. 24 52 402. As a flat stamped part, it has two connection parts on the two sides. In the center is located a U-shaped contact form which is connected with a strip part via a central web. Two U-shaped terminal lugs, whose ends project at the bottom from the housing of the socket terminal strip, join the strip part on both sides. With these two terminal lugs the fork spring together with the housing is soldered into a single printed-circuit board.

An edge type plug-and-socket connection for printed-circuit boards is known from DE-OS No. 28 51 712. A U-shaped contact fork which is connected with two plug-type connections for connection wires via a web, serves for contacting the conductor strips. The connection wires are stripped at the end. The connection wires are held in the plug-type connections by hooks designed as resilient arms, which are tilted toward the center in the direction of the plugging of the connection wire.

A plug-and-socket connection for connecting two printed-circuit boards with a U-shaped fork spring is also described in DE-PS [West German Patent] No. 2,104,406. A housing has several chambers in which the individual fork springs are inserted. These fork springs are made of a single stamped part which is bent on a bending edge in such a way that two practically symmetrical contact spring parts are formed. In addition, a tab is provided which serves to keep the two parts together after joining. No connection part is necessary due to the fact that this is a plug-and-socket type connection between two printed-circuit boards located in the same plane.

SUMMARY OF THE INVENTION

It is the object of the present invention to provide an improved socket terminal strip which offers a greater number of connection possibilities with different assignment of the contacts in several planes, without any increase in the number of contacts.

In accordance with the above object, there is provided a socket terminal strip connector apparatus for receiving a complimentary plug strip, having a plurality of chambers in each of which a pair of contact members is arranged. Each contact member is connected through connection parts to a lug, and has plural bending points at which it can be bent. A first contact member of each pair is bent so that its lug exits the connector in a first direction, and the second is bent so that its lug exits the connector in a second, opposite direction. The contact members of each pair are normally in electrical contact, or are made so when the plug strip is inserted, thereby providing that electrically common lugs can be connected to different circuit boards, increasing the number of connections that can be made to the plug strip.

BRIEF DESCRIPTION OF THE DRAWINGS

The present invention is explained below in more detail with respect to two embodiments based on the following drawings.

DESCRIPTION OF THE PREFERRED EMBODIMENTS

Figure 1:
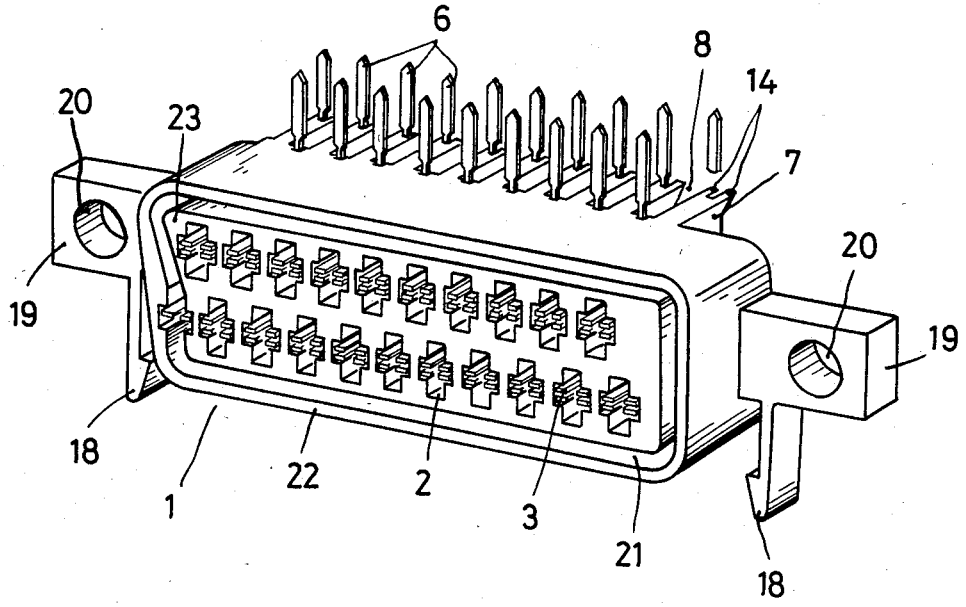
FIG. 1 is a front perspective view of a socket terminal strip of this invention.

FIG. 1 shows a perspective view of a socket terminal strip which consists of an enlarged insulating body 1 made of plastic. A lug 19 in which a hole 20 is prepared is molded on each of the narrow sides of the body. A holding tongue 18 is molded on the bottom side of each lug providing means by which the insulating body can be snapped into and held in a printed-circuit board (not shown in the figures). Together with the printed-circuit board the insulating body is fastened to a chassis by screws extending through the holes 20. On the front side the insulating body 1 is provided with a circular or oblong recess 21, for receiving the metallic screening of the plug. A circular or oblong edge 22 and a middle part 23 are defined by the recess 21 in the insulating body 1. A fork spring which grounds the screening of the plug is inserted as a contact member into the recess 21.

Two-staggered rows of chambers 2 extending parallel in the longitudinal direction of the insulating body are provided in the middle part 23. Contact members 3 in the form of U-shaped fork springs are inserted into the chambers. When a plug strip is plugged into the socket terminal strip, the knife contact pins of the plug strip, which have a width of 3.6 mm, come into electrical contact with the fork springs. There are ten chambers in one of the rows, while the other row also contains ten chambers as well as the additional ground contact.

Figure 2:
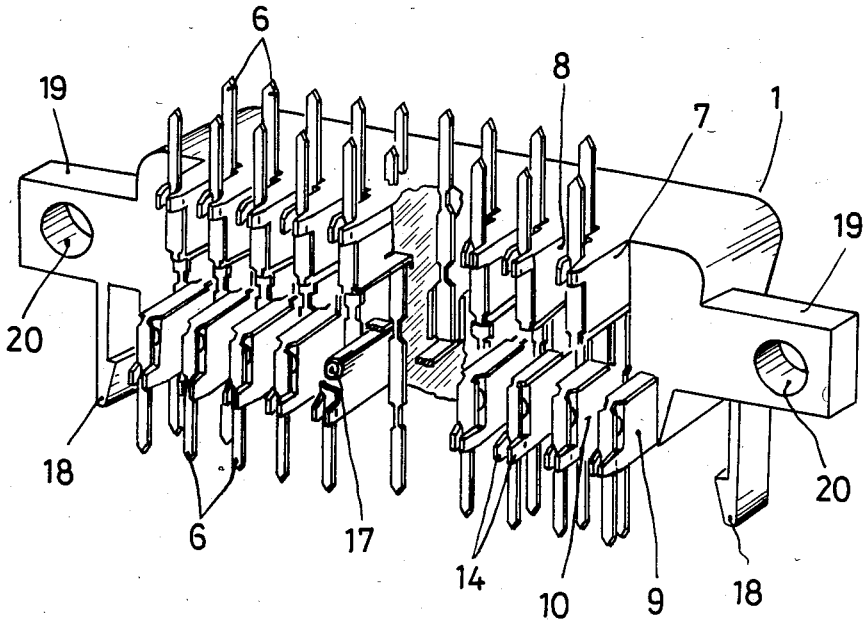
FIG. 2 is a rear perspective view of the socket terminal strip.

The back side of the insulating body 1 is shown in FIG. 2 in a perspective view. Webs 7 and incisions 8 extend alternatively in a chamber-like pattern in the first row along the upper longitudinal edge of the insulating body. Webs 9 and incisions 10 are located, also in a chamber-like pattern, in a second row along the lower longitudinal edge. The two rows are staggered relative to each other, so that a web 7 of the first row faces an incision 10 of the second row, and a web 9 of the second row faces an incision 8 of the first row. The webs are arranged at right angles to the longitudinal edges and they extend, as can be seen in FIG. 2, to about one third of the width of the insulating body 1, i.e., to the point at which the openings through which the contact members projecting from the insulating body are located.

Figure 3:
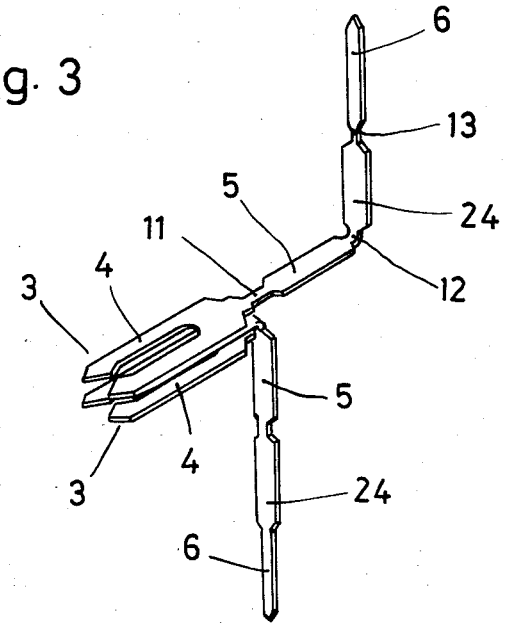
FIG. 3 is a perspective view of two contact members arranged in one chamber, in accordance with this invention.

FIG. 3 shows a perspective view of a pair of contact members 3 located in a chamber without an insulating body. These are so-called fork springs. They consist of a pair of U-shaped contact parts 4, each of which is joined through two connection parts 5, 24 to a terminal lug 6. A taper is provided between the contact part 4 and the first connection part 5, providing a first predetermined bending point 11. There is another taper between the first connection part 5 and the second connection part 24, so that a second predetermined bending point 12 is thus formed. Finally, the terminal lug 6 and the second connection part 24 are connected with each other by another tapered section, which forms the fastening point 13. The contact member can now be bent at approximately a right angle as needed at the predetermined bending points, or at the fastening point as well.

In order to increase the possibilities of the external wiring, each chamber is provided with first and second contact members which are congruent at least with respect to the contact parts 4. The terminal lugs can, however, be different, e.g., suitable for printed-circuit boards, for wire connections, etc. The two contact members of one chamber are bent at different predetermined bending points. Thus, one contact element may be bent at the second predetermined bending point, and led over the web, e.g., of the first row, while the other contact member is bent at the first predetermined bending point, and lies in the incision of the other row which is opposite to the web. Thus, the two terminal lugs are parallel but in different planes, and reach out of the insulating body on different sides.

Figure 5:
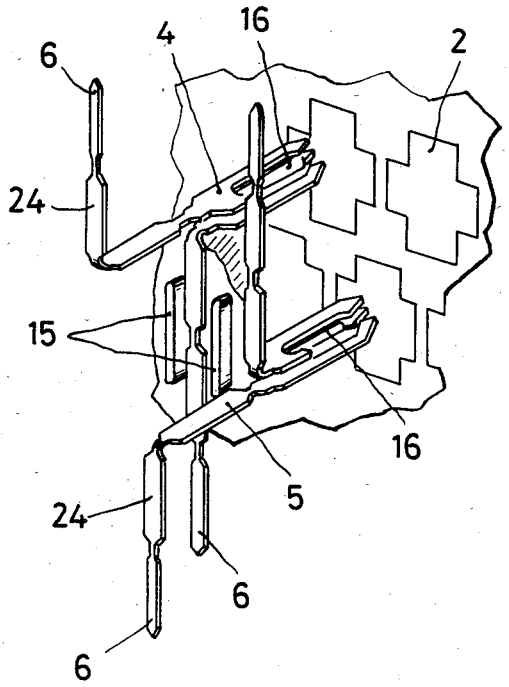
FIG. 5 is a schematic perspective view of two pairs of contact members arranged next to each other, in accordance with this invention.

Alternating terminal lugs 6 extending from one surface, e.g., the upper surface as viewed in FIG. 1, have contact members which are bent at respective different bending points. Referring to FIG. 5, there are shown two alternating, or adjacent lugs 6 which extend upward (as well as two which extend downward). A first contact member from the lower row is bent upward at the first predetermined bending point, and extends through an incision in the upper row (see also FIG. 2); the adjacent contact member from the upper row is bent upward at the second bending point and led along the contour of its web in the upper row. Thus, the two lugs 6 lie in different planes; the one from the lower chamber lies in the upper incision, while the one from the upper chamber reaches out of the insulating body at the level of the top edge of the web. Conversely, for the two contact members having lugs that extend downward, the one with the rearward lug is bent at the second bending point and connects to a contact part 4 in a lower chamber, while the one with the forward lug is bent at the first bending point and connects to a contact part 4 in an adjacent upper chamber.

In order to separate the individual connection parts better and in an electrically more reliable manner, thin ribs 15 are molded on the insulating body between the individual connection parts. These ribs extend between the webs and incisions of the two rows. This is shown in FIG. 5.

To fasten the contact members to the insulating body, tongues 14 which are deformable, and by means of which the contact members are fastened at the fastening points 13, are provided at the webs and in the incisions on the side of the longitudinal edge. The fixation is carried out by hot forming of the tongues, e.g., with a die.

As can be seen in FIG. 2, a support pin 17 is molded at each web on which the connection part is supported. The support pins are located on that end of the webs which is opposite to the tongues 14.

Figure 4:
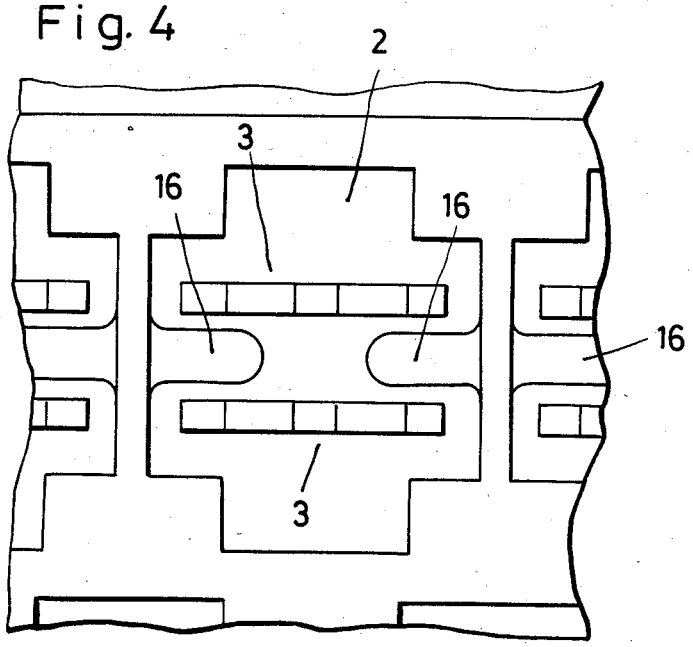
FIG. 4 is an illustration of a chamber of another socket terminal strip on a larger scale.

In a first embodiment the two contact members are located in the chambers in such a way that the two contact parts touch each other. In another second embodiment according to FIG. 4, the contact parts are separated from each other by partitions 16. When the relatively broad pin of the plug is pushed in, the two contact members become connected with each other electrically. The pin of the plug thus assumes the function of a contact bridge.

I claim:

1. Socket terminal strip connector apparatus for receiving a complimentary plug strip, having an insulating body, a plurality of chambers arranged in one face of said insulating body for receiving conductive elements of said plug strip, a pair of contact members corresponding to each of said chambers, each contact member of each pair having a contact part located in a given chamber, a connection part, a lug, and at least first and second bending points at which each said contact member can be bent, a first contact member of each being bent at a said first bending point so that its lug exits the connector in a first direction, and the second contact member being bent at said second bending point and in an opposite direction so that its lug exits the connector in a second opposite direction, said contact members of each pair being normally in electrical contact with said plug strip when it is inserted into said chambers, whereby electrically common lugs from each chamber can be connected to different circuit boards.

2. Socket terminal strip apparatus in accordance with claim 1, wherein said chambers are arranged in two longitudinal chamber rows, said insulating body having, on a side thereof opposite said one face, two opposite rows of alternating webs and incisions, said webs and incisions extending longitudinally and corresponding to said two chamber rows;

said opposite rows being staggered relative to each other in such a way that webs of a first opposite one of said rows are opposite to incisions of a second one of said opposite row, and webs of a second one of said opposite rows are opposite to incisions of a first one of said opposite rows;

said lugs being arranged in first and second planes, and wherein for each chamber row the contact members having lugs in said first plane pass through an incision of the opposite row corresponding to the other chamber row, and the contact members having lugs in said second plane are led along the contour of webs in the corresponding opposite row.

3. The socket terminal strip apparatus in accordance with claim 2, characterized in that each said web has an opening through which a lug projects.

4. The socket terminal strip apparatus in accordance with claim 2, characterized in that said webs and said incisions have deformable tongues molded on the edges thereof for fixing said contact members.

5. The socket terminal strip apparatus in accordance with claim 2 characterized by having molded ribs on said opposite side of said insulating body in the interspace between said two rows of webs, for separating said connection parts.

6. The socket terminal strip apparatus in accordance with claim 1, characterized in that the two contact parts of the contact members located in one chamber touch each other.

7. The socket terminal strip apparatus in accordance with claim 1, characterized by partitions that reach into said chambers for normally separating the two contact parts of the contact members located in each chamber.

8. The socket terminal strip apparatus in accordance with each of claims 3 through 7, characterized in that each said contact part is U-shaped.

9. The socket terminal strip apparatus in accordance with claim 1, characterized in that each said contact member is tapered at each said bending point.

10. The terminal strip apparatus in accordance with claim 2, characterized in that each said web comprises molded, projecting support pins for said connection parts.

* * * * *

UNITED STATES PATENT AND TRADEMARK OFFICE

CERTIFICATE OF CORRECTION

PATENT NO. : 4,568,136
DATED : February 4, 1986
INVENTOR(S) : Oswald Reuss

It is certified that error appears in the above-identified patent and that said Letters Patent is hereby corrected as shown below:

Claim 2, Column 4, Line 62, delete "opposite";
Column 4, Line 63, insert "opposite" before
before the word --rows--

Signed and Sealed this

*Twenty-second* Day of *April 1986*

[SEAL]

*Attest:*

DONALD J. QUIGG

*Attesting Officer* *Commissioner of Patents and Trademarks*